US005832970A

United States Patent [19]

Carow

[11] Patent Number: 5,832,970

[45] Date of Patent: Nov. 10, 1998

[54] LIQUID DISPENSING NOZZLE

[75] Inventor: Walter M. Carow, Roane, Tenn.

[73] Assignee: Richards Industries, Inc., Rockwood, Tenn.

[21] Appl. No.: 895,706

[22] Filed: Jul. 17, 1997

[51] Int. Cl.[6] ..... B67D 5/00

[52] U.S. Cl. ..... 141/206; 141/59; 141/392

[58] Field of Search ..... 141/59, 206, 209, 141/290, 392

[56] References Cited

U.S. PATENT DOCUMENTS

| | | | |
|---|---|---|---|
| 3,012,592 | 12/1961 | Wright et al. . | |
| 3,088,500 | 5/1963 | Payne . | |
| 3,330,479 | 7/1967 | Vollprecht . | |
| 3,380,491 | 4/1968 | Rosell et al. . | |
| 3,811,486 | 5/1974 | Wood . | |
| 3,866,636 | 2/1975 | Lasater | 141/59 |
| 3,908,718 | 9/1975 | Bower . | |
| 3,974,865 | 8/1976 | Fenton et al. . | |
| 3,982,571 | 9/1976 | Fenton et al. . | |
| 3,996,979 | 12/1976 | Barr et al. . | |
| 4,056,131 | 11/1977 | Healy . | |
| 4,057,086 | 11/1977 | Healy . | |
| 4,060,110 | 11/1977 | Bower | 141/207 |
| 4,068,687 | 1/1978 | Long . | |
| 4,139,032 | 2/1979 | Taylor et al. | 141/206 |
| 4,199,012 | 4/1980 | Lasater | 141/52 |
| 4,206,791 | 6/1980 | Bower . | |
| 4,232,715 | 11/1980 | Pyle . | |
| 4,331,190 | 5/1982 | Sutcliffe et al. . | |
| 4,343,337 | 8/1982 | Healy . | |
| 4,351,375 | 9/1982 | Polson | 141/98 |
| 4,378,824 | 4/1983 | Carder, Sr. . | |
| 4,497,350 | 2/1985 | Guertin | 141/206 |
| 4,572,255 | 2/1986 | Rabinovich . | |
| 5,085,258 | 2/1992 | Fink, Jr. et al. | 141/206 |
| 5,141,037 | 8/1992 | Carmack et al. | 141/206 |
| 5,213,142 | 5/1993 | Koch et al. | 141/59 |
| 5,386,859 | 2/1995 | Healy | 141/59 |
| 5,390,712 | 2/1995 | Parrish et al. | 141/59 |
| 5,394,909 | 3/1995 | Mitchell et al. | 141/59 |
| 5,474,115 | 12/1995 | Fink, jr. | 141/206 |
| 5,603,364 | 2/1997 | Kerssies | 141/392 |
| 5,620,031 | 4/1997 | Dalhart et al. | 141/206 |

*Primary Examiner*—J. Casimer Jacyna
*Attorney, Agent, or Firm*—Pitts & Brittian, P.C.

[57] ABSTRACT

A liquid dispensing nozzle for dispensing a liquid into a receptacle, and for recovering vapor from the receptacle during dispensing. The liquid dispensing nozzle (10) includes a body (12) defining a liquid passageway (14) therethrough and a vapor passageway (16) therethrough. The nozzle also has a spout assembly (17) including a liquid tube (134) for being placed in fluid communication with the liquid passageway (14) of the body (12). The spout assembly also including a spout tube (136). The liquid tube (134) is disposed within the spout tube (136) such that a further vapor passageway (16[1]) is defined within the spout tube (136). The spout assembly (17) also includes a support ring (138) for releasably securing the spout tube (136) to the body (12), with the support ring (138) defining a passageway therethrough which establishes fluid communication between the further vapor passageway (16[1]) and the vapor passageway (16) of the body (12). A first tube support member (150) is provided for holding the liquid tube (134) in position within the spout tube (136) and to facilitate the communication of liquid to the liquid tube (134), the first tube support member (150) defining a liquid passageway (154) communicating with the liquid tube (134). Further, a check valve housing (168) is provided for establishing fluid communication between the liquid passageway (14) of the body (12) and a liquid passageway (154) of the first tube support member (150).

14 Claims, 4 Drawing Sheets

LIQUID DISPENSING NOZZLE

TECHNICAL FIELD

This invention relates to a liquid dispensing nozzle which recovers vapor, such as fuel vapor, from a receptacle while a liquid, such as fuel, is being dispensed into such receptacle. In this particular invention the body of the nozzle defines both a liquid passageway and a vapor passageway, and the nozzle includes a spout assembly which accommodates the communication of both the liquid which is being dispensed and the vapor which is recovered during the dispensing operation.

BACKGROUND ART

Dispensing nozzles which recover vapor from a receptacle or tank being filled are well known in the art. Indeed, many legal jurisdictions require some type of vapor recovery system to be employed whenever fuels, such as gasoline, are being dispensed such that fuel vapor is not allowed to escape into the atmosphere. One type of vapor recovery nozzle is a bellows-type nozzle such as the nozzle disclosed in U.S. Pat. No. 3,974,865. In this type nozzle a bellows device is provided around the discharge spout of the nozzle so as to create a vapor recovery chamber around the spout which receives vapor from the receptacle being filled. A vacuum device of some type is typically provided to recover the vapor from the recovery chamber. However, nozzles provided with such bellows devices are bulky and awkward to use. Further, in recent years the preferred means of communicating fuel to a dispensing nozzle, while at the same time recovering vapor, is to use a dispensing hose which incorporates two concentrically disposed hose members so as to define a centrally disposed vapor passageway for recovering vapor, surrounded by a liquid passageway for communicating liquid to the nozzle. Given this hose construction, in recent years efforts have be directed toward devising nozzles wherein a vapor passageway is incorporated into the body and the spout assembly of the nozzle, thereby eliminating the need for a clumsy bellows device surrounding the discharge spout. An example of one such nozzle is disclosed in U.S. Pat. No. 4,351,375.

Other dispensing devices are disclosed in U.S. Pat. Nos. 4,572,255; 4,378,824; 4,343,337; 4,331,190; 4,232,715; 4,206,791; 4,199,012; 4,068,687; 4,060,110; 4,057,086; 4,056,131; 3,996,979; 3,982,571; 3,908,718; 3,811,486; 3,380,491; 3,330,479; 3,088,500; and 3,012,592.

Whereas in recent years the preferred means for recovering vapor during the dispensing of fuel is to provide a nozzle which internally incorporates a vapor recovery passageway, great difficulty has been encountered in incorporating vapor recovery passageways in nozzles without making the nozzles unduly complicated and expensive to manufacture and maintain. For example, it is desirable to provide fuel dispensing nozzles with both an automatic shut-off mechanism which terminates dispensing when the receptacle being filled is full and an automatic shut-off mechanism which terminates or prohibits dispensing in absence of dispensing pressure from the dispensing pump of a preselected value. Providing a vapor recovery passageway through the nozzle while also accommodating such automatic systems is difficult, and can result in unwanted complexity.

Therefore, it is an object of the present invention to provide a liquid dispensing nozzle capable of recovering vapor from the receptacle into which liquid is being dispensed.

It is another object of the present invention to provide a liquid dispensing, nozzle having a vapor recovery passageway which extends through the body of the nozzle and through the discharge spout of the nozzle.

Yet another object of the present invention is to provide a liquid dispensing nozzle which is inexpensive to manufacture and maintain.

SUMMARY OF THE INVENTION

The present invention provides a liquid dispensing nozzle for dispensing a liquid, such as gasoline, into a liquid receptacle, such as the gas tank of a vehicle, and for recovering vapor from the liquid receptacle during dispensing. The liquid dispensing nozzle includes a body defining a liquid passageway therethrough, the liquid passageway being provided with a first inlet for being placed in fluid communication with a liquid dispensing device and a first outlet. The body of the nozzle further defines a vapor passageway therethrough, with the vapor passageway defining a second inlet through which vapor is received from the liquid receptacle during dispensing, and defining a second outlet through which vapor exits the body of the nozzle.

The nozzle is provided with a spout assembly including a liquid tube for being placed in fluid communication with the first outlet of the nozzle body so as to communicate liquid from the liquid passageway of the body to the receptacle. The spout assembly also including a spout tube for being placed in fluid communication with the second inlet of the nozzle body to facilitate the communication of vapor from the liquid receptacle to the second inlet of the body. In this regard, the liquid tube is disposed within the spout tube such that a further vapor passageway is defined within the spout tube between the liquid tube and the spout tube. The spout assembly also includes a support ring for releasably securing the spout tube to the body of the nozzle. The support ring defines proximal and distal end portions and a passageway therethrough. The distal end portion of the support ring is provided with a receptor for releasably receiving a proximal end portion of the spout tube, with the support ring further including a mechanism for releasably securing the support ring to the body of the nozzle whereby the passageway of the support ring is in fluid communication with the vapor passageway of the nozzle body.

a first tube support member is provided for holding the liquid tube in position within the spout tube and to facilitate the communication of liquid from the first outlet of the body of the nozzle to the liquid tube. In this regard, the first tube support member defines a liquid passageway therethrough and defines a first end portion which is received in the proximal end portion of the support ring. Further, the first end portion of the first tube support member is provided with a receptor for receiving a proximal end portion of the liquid tube, thereby establishing fluid communication between the liquid tube and the liquid passageway of the first tube support member. Also provided is a check valve housing for establishing fluid communication between the first outlet of the body of the nozzle and the liquid passageway of the first tube support member. The check valve housing defines a liquid passageway therethrough for communicating with the liquid passageway of the nozzle body and defines a first end portion for engaging the body of the nozzle proximate the first outlet so as to place the liquid passageway of the body in fluid communication with the liquid passageway of the check valve housing. The check valve housing has a second end portion for engaging the second end portion of the first tube support member so as to establish fluid communication between the liquid passageway of the first tube support member and the liquid passageway of the check valve housing. Accordingly, as liquid is dispensed, liquid flows from the liquid passageway of the nozzle body into the liquid passageway of the check valve housing, and, from the liquid passageway of the check valve housing, through the liquid passageway of the first support member into the liquid tube which carries the liquid to the receptacle being filled. Further, as liquid is dispensed, vapor is received into the further vapor passageway defined within the spout tube and is communicated through the passageway of the support ring to the vapor passageway of the nozzle body.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
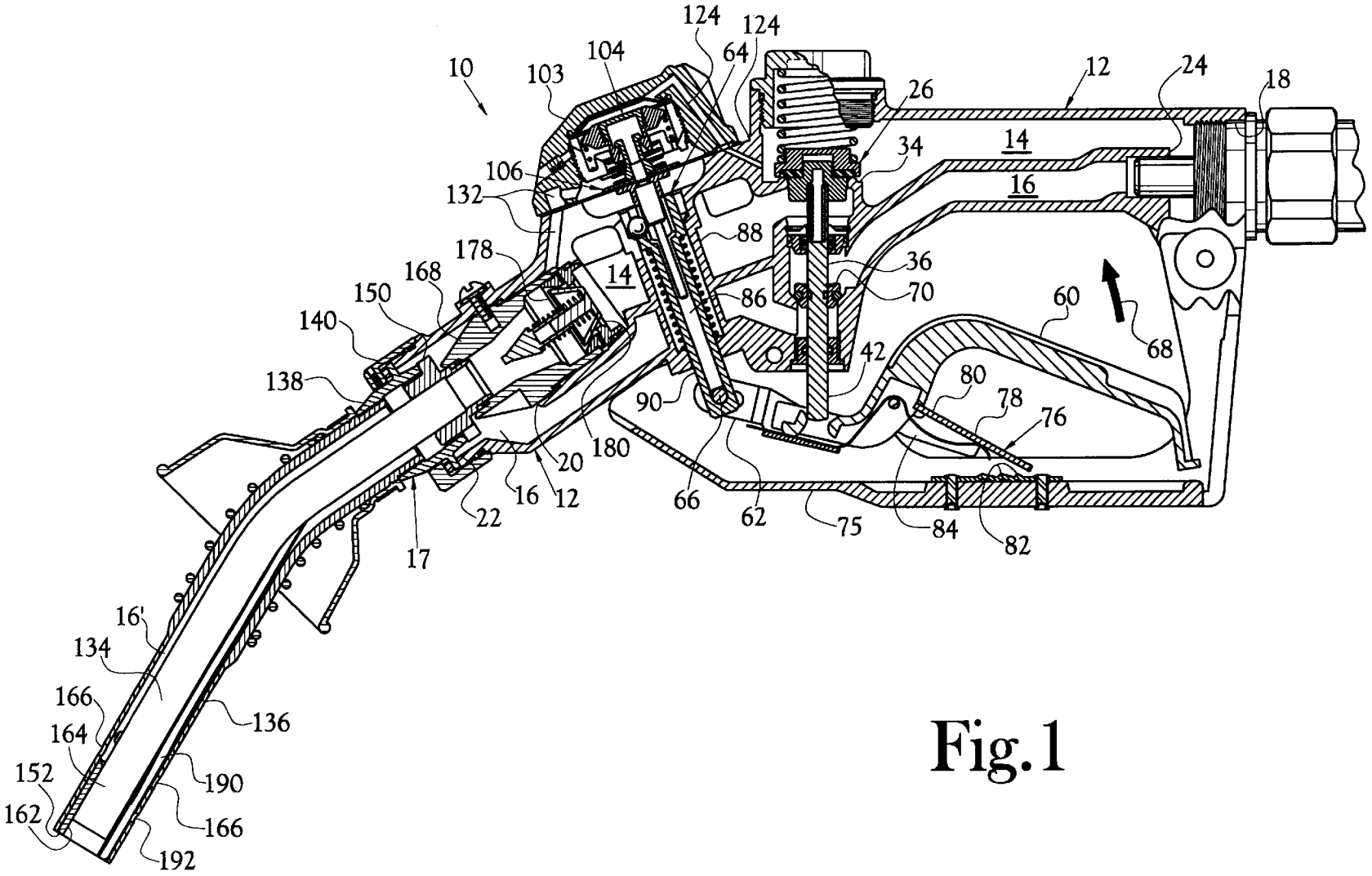
FIG. 1 illustrates a side elevation view, in section, of a liquid dispensing nozzle of the present invention.

A liquid dispensing nozzle incorporating various features of the present invention is illustrated generally at 10 in the Figures. The nozzle 10 includes a body 12 defining a liquid passageway 14 for communicating a liquid, such as gasoline, through the body 12. The body 12 also defines a vapor passageway 16 for communicating vapor, such as gasoline vapor, through the body 12. More specifically, the body 12 includes a first inlet 18 communicating with the liquid passageway 14, and for being placed in fluid communication with a liquid dispensing device, such as the dispensing hose 15. Further, the body 12 includes a first outlet 20 communicating with the liquid passageway 14 such that liquid which is received from a dispensing device through the first inlet 18, and which is communicated through the liquid passageway 14, exits the liquid passageway 14 through the first outlet 20.

The body 12 also includes a second inlet 22 communicating with the vapor passageway 16, and includes a second outlet 24 communicating with the vapor passageway 16. As will be discussed in detail below, vapor which is recovered from the fuel tank, or other container into which liquid is being dispensed, is communicated into the vapor passageway 16 through the second inlet 22, and exits the vapor passageway 16 through the second outlet 24 to be recovered through the vapor passageway of a hose (not shown), or other recovery device.

Figure 2:
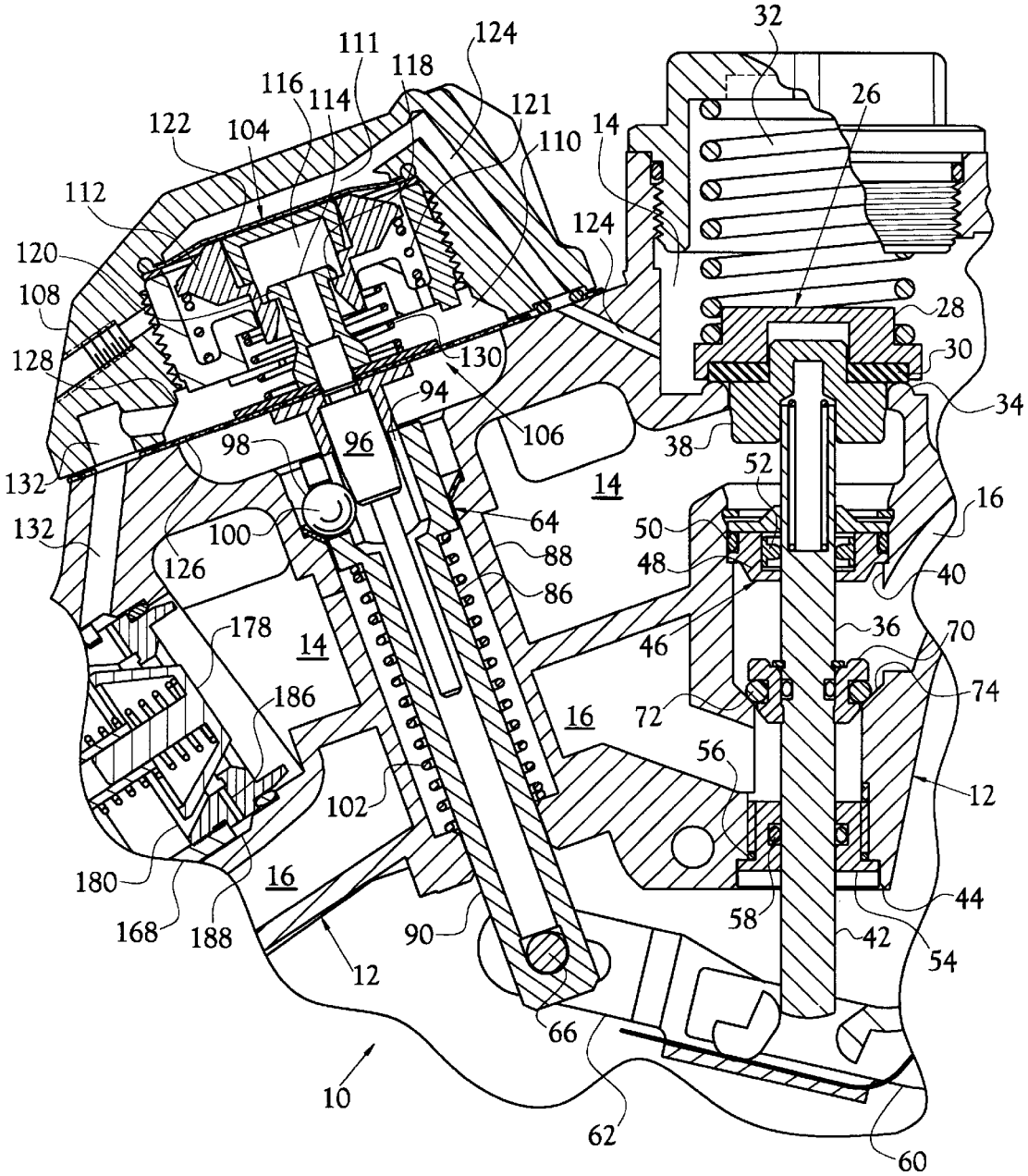
FIG. 2 illustrates a partial side elevation view, in section, of a liquid dispensing nozzle of the present invention.

In order to selectively terminate the flow of liquid through the liquid passageway 14, the nozzle 10 is provided with a main valve 26 mounted between the first inlet 18 and the first outlet 20. In the preferred embodiment, and as best illustrated in FIG. 2, the main valve 26 includes a valve top 28 provided with an annular seal member 30. The valve top 28 is downwardly biased by a main valve spring 32 such that the seal member 30 releasably engages an annular valve seat 34 defined by the body 12 thereby selectively closing the passageway 14 to the flow of liquid. In order to facilitate the selective opening of the main valve 26, the main valve 26 is provided with an actuator stem 36 having a poppet disk 38 mounted at its upper end for engaging the valve top 28 and the seal member 30. The stem 36 is received through an opening 40 in the wall defining the liquid passageway 14, and a lower end portion 42 of the stem 36 is received through an opening 44 in the body 12 such that a preselected portion of the stem 36 is exterior to the body 12.

In order to insure the fluid impervious integrity of the liquid passageway 14 the stem 36 extends through a seal member 46 which is disposed in the opening 40. The seal member 46 includes a seal housing 48 provided with an outer O-ring seal 50 for engaging the body 12 and provided with an inner seal 52 between the seal housing 48 and the stem 36 such that the stem 36 can be selectively reciprocated without compromising the fluid-tight integrity of the liquid passageway 14. It will also be noted that the stem 36 extends through the vapor passageway 16 before exiting the body 12. In order to insure the fluid impervious integrity of the vapor passageway 16 while allowing selective reciprocation of the stem 36, the stem 36 is journalled through a core bearing 54 which is seated in the opening 44. The core bearing 54 is provided with an outer O-ring seal 56 for engaging the body 12 and an inner O-ring seal 58 for engaging the stem 36 such that the stem 36 can be selectively reciprocated without compromising the fluid-tight integrity of the vapor passageway 16.

With the actuator stem 36 thusly mounted, the main valve 26 is selectively opened by manipulation of an operating lever 60. The lever 60 is pivotally mounted at a proximal end portion 62 to a latch mechanism 64 (discussed in detail below) at a selectively fixed pivot point 66. Thus, when the pivot point 66 is in the fixed position illustrated in FIGS. 1 and 2, the lever 60 can be pivoted in the direction of arrow 68 so as to contact the actuator stem 36 and force the seal member 30 and valve top 28 in an upward direction to open the valve 26. When the lever 60 is released, the downward biasing provided by the valve spring 32 causes the main valve 18 to close once again.

The nozzle 10 also includes a vapor valve 70 which is mounted within the vapor passageway 16 between the second inlet 22 and second outlet 24 for selectively terminating the flow of vapor through the vapor passageway 16. In the preferred embodiment the vapor valve 70 is mounted on the actuator stem 36, and is provided with an outer O-ring seal 72 for selectively engaging a valve seat 74 defined by the body 12 within the vapor passageway 16. Accordingly, manipulation of the operating lever 60 simultaneously operates both the main valve 26 and the vapor valve 70 such that when the lever 60 is depressed both valves move to an open position, and, when the lever 60 is released, both valves move to a closed position. It will also be noted that in the preferred embodiment the nozzle 10 is provided with guard member 75 to protect the lever 60 from inadvertent actuation, and provided with a hold-open mechanism 76 for releasably maintaining the main valve 26 and the vapor valve 70 in open positions without the user maintaining pressure on the lever 60. (See FIG. 1). The hold-open mechanism 76 includes a latch member 78 pivotally secured to the lever 60 at a proximal end portion 80. The latch member 78 selectively pivots into engagement with one of a plurality of teeth 82 provided on the guard member 75 to releasably brace the lever 60 in a selected open position. A spring member 84 is also provided for biasing the latch member 78 to a raised position when it is not engaged with one of the teeth 82.

As noted above, the nozzle 10 also includes a latch mechanism 64. This latch mechanism 64 selectively disables the operating lever 60 in order to close the main valve 26 and the vapor valve 70. As best illustrated in FIG. 2, the latch mechanism 64 includes a latch plunger 86 slidably mounted within a plunger housing 88 formed by the body 12. The plunger 86 defines a lower end portion 90 which pivotally engages the operating lever 60 at the selectively fixed pivot point 66. The plunger 86 also has an upper end portion defining a latch pin receptor cup 94 for slidably receiving a latch pin 96. Further, the receptor cup 94 is provided with a plurality of sidewall openings 98 (only one being shown), each of which receives an operatively associated latch ball 100 (only one being shown).

As indicated above, the latch pin 96 is slidably received in the latch pin receptor cup 94. It will be appreciated that when the latch pin 96 is positioned within the receptor cup 94, the balls 100 are forced outwardly, and as long as the latch pin 96 remains in the receptor cup 94, those portions of the balls 100 which extend beyond the exterior diameter of the plunger 86 prohibit the plunger 86 from moving downwardly within the plunger housing 88. Thus, the pivot point 66 remains fixed such that the pivoting of the operating lever 60 serves to selectively open the main valve 26 and vapor valve 70. However, if the latch pin 96 is removed from the receptor cup 94, the balls 100 are allowed to withdraw into the receptor cup 94 and no longer serve to prohibit the downward movement of the plunger 86. Therefore, if the operating lever 60 is depressed, the plunger 86 moves downwardly, and the lever 60, being denied a fixed pivot point, will not serve to open the main valve 26, or vapor valve 70. It will also be noted that a spring member 102 is provided in order to upwardly bias the plunger 86 such that it will return to the locked, upwardly disposed, position when the lever 60 is at rest.

In order to facilitate the safe use of the hold-open mechanism 76, the nozzle 10 is provided with a first automatic shut-off mechanism 104 for closing the main valve 26 and the vapor valve 70 when supply pressure from the dispensing pump falls below a preselected value, and is provided with a further automatic shut-off mechanism 106 for closing the main valve 26 and the vapor valve 70 when the fuel or liquid in the tank being filled reaches the level of the discharge end of the nozzle 10. In this regard, a cap member 108, releasably secured to the body 12, is provided. The cap member 108 together with an annular recess provided in the body 12 serve to define a chamber 110 above the plunger housing 88, the chamber 110 serving to partially house the automatic shut-off means 104 and 106.

The first automatic shut-off means 104 includes a pressure plunger 112 positioned within the chamber 110 so as to be capable of reciprocation along a common axis with the latch pin 96. A diaphragm plunger 114 is secured to the upper end portion of the latch pin 96, the diaphragm plunger 114 defining an upper end portion which is received in a receptor 116 provided in the pressure plunger 112. It will be noted that the mouth of the receptor 116 defines a ledge 118 which engages a lip 120 provided on the distal end of the diaphragm plunger 114. As a consequence, upward movement of the pressure plunger 112 lifts the diaphragm plunger 114 and the latch pin 96 so as to disable the lever 60. In this regard, a spring member 121 is provide in order to bias the pressure plunger 112 upwardly to a position whereby the lever 60 is disabled.

In order to selectively move the pressure plunger 112 downward to enable the lever 60, the first automatic shut-off means is provided with a pressure diaphragm 122 mounted within the chamber 110, above the pressure plunger 112 such that the pressure diaphragm 122 serves as a fluid impervious barrier transversely dividing the upper portion of the chamber 110 so as to define a pressure chamber 111. The pressure diaphragm 122 is fabricated of a flexible or resilient material so as to be moveably responsive to changes in relative pressure on opposite sides of the pressure diaphragm 122. Therefore, selective increases in fluid pressure within the pressure chamber 111 result in downward movement of the pressure diaphragm 122 which forces the pressure plunger 112, and, thus, the latch pin 96 downwardly to enable the lever 60. In order to make the enablement of the lever 60 dependent on there being supply pressure of a selected value from the dispensing pump, a conduit 124 is defined by the cap member 108 and body 12 which places the pressure chamber 111 in fluid communication with the liquid passageway 14 at a point up stream from the main valve 26. Accordingly, when the supply pressure to the nozzle 10 reaches a certain value the attendant pressure increase in the pressure chamber 111 moves the pressure diaphragm 122 and the pressure plunger 112 downwardly, allowing spring 130 to force the latch pin 96 downwardly so as to enable the operating lever 60. When supply pressure from the dispensing pump falls below the preselected level, as when the pump is turned off, the pressure diaphragm 122 no longer serves to move the pressure plunger 112 downwardly against the bias of the spring member 121, and the operating lever 60 is disabled. Accordingly, the main valve 26, and the vapor valve 70, are prevented from being latched open when the supply pressure is cut off remotely by dollar fill control such that vapor cannot escape and liquid will not flow when the pump is turned on again.

Figure 3:
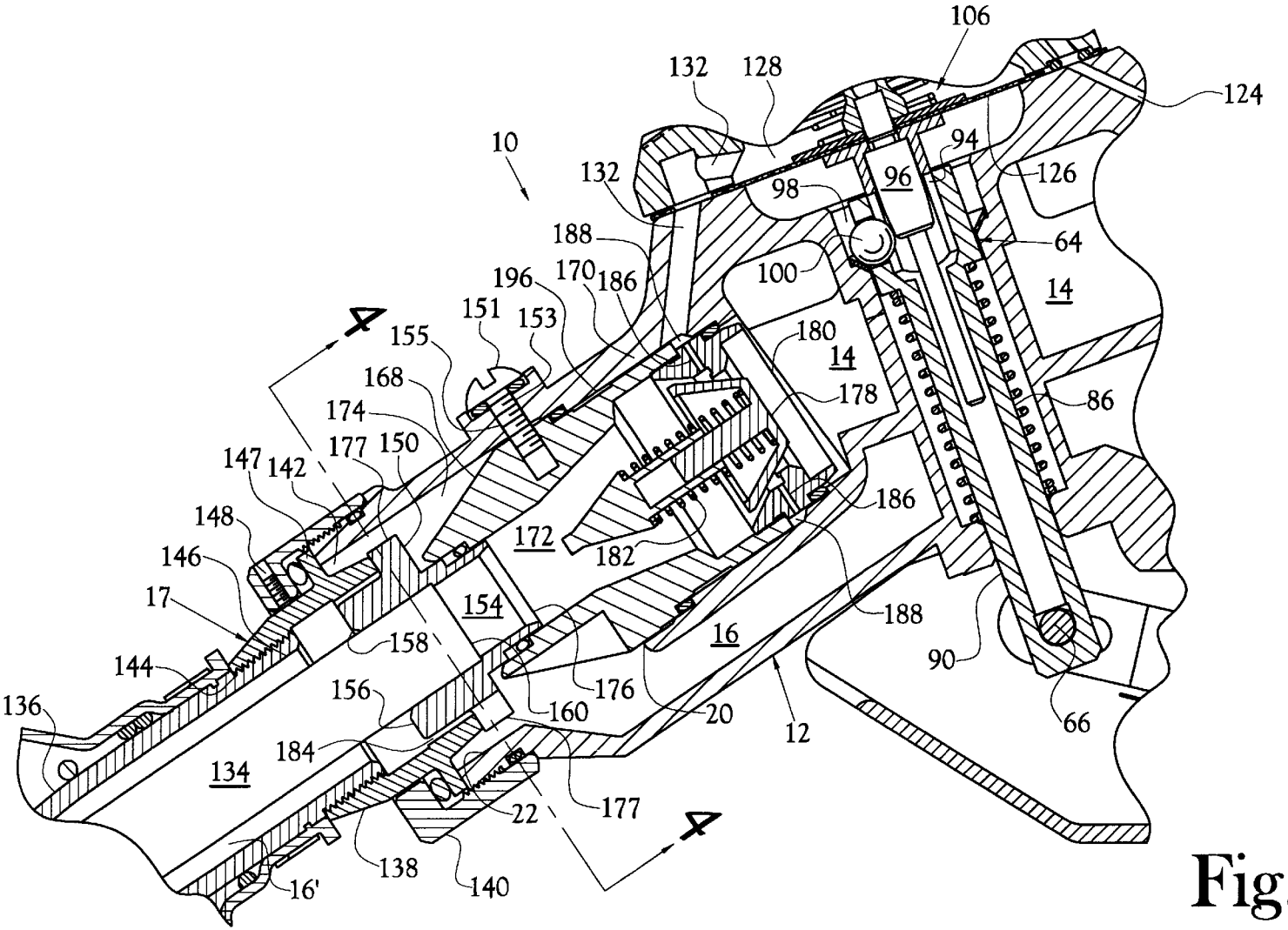
FIG. 3 illustrates a partial side elevation view, in section, of a liquid dispensing nozzle of the present invention.
Figure 5:
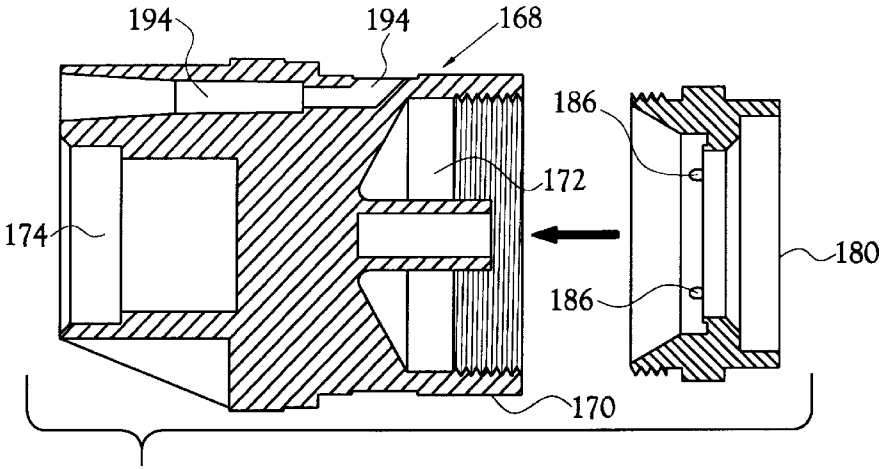
FIG. 5 illustrates a side elevation view, in section taken at 5—5 in FIG. 6, of a check valve housing of the liquid dispensing nozzle of the present invention.
Figure 7:
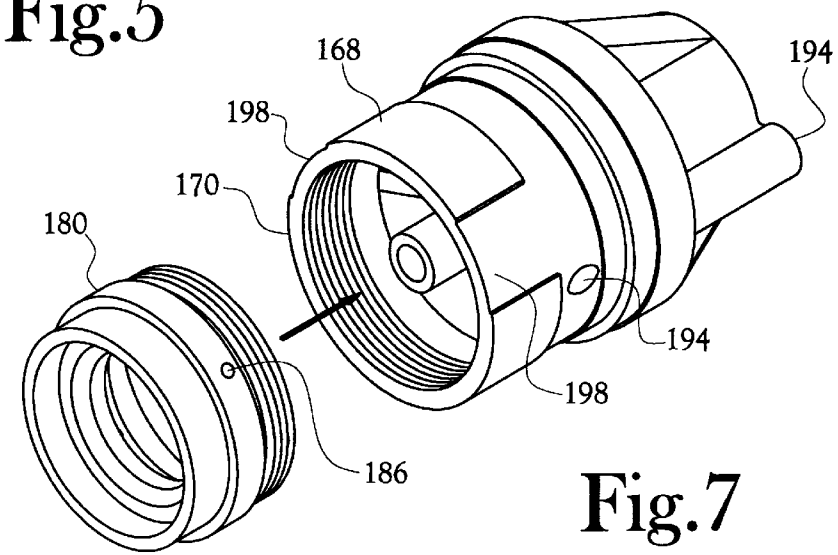
FIG. 7 illustrates an exploded perspective view of a check valve housing and valve seat member of the liquid dispensing nozzle of the present invention.

With regard to the further automatic shut-off mechanism 106, and as best illustrated in FIG. 2 and 3, the latch pin 96 is secured to a vacuum diaphragm 126. The diaphragm 126 is mounted between the cap member 108 and the body 12, and together with the latch pin 96 forms a fluid impervious barrier transversely dividing the chamber 110 so as to define a vacuum chamber 128. The vacuum diaphragm 126 is fabricated of a resilient or flexible material so as to be moveably responsive to changes in the relative pressure on opposite sides of the diaphragm 126. Also, a latch pin spring 130 is provided in order to bias the latch pin 96 downwardly to a closed or latched position. The removal of the latch pin 96 from the receptor cup 94 in order to close the main valve 26 and vapor valve 70 when the tank being filled is full is accomplished through the selective generation of a partial vacuum in the vacuum chamber 128 which causes the vacuum diaphragm to collapse inwardly resulting in a lifting of the latch pin 96. As will be discussed in detail below, the vacuum necessary to effect such automatic closing of the main valve 26 and vapor valve 70 is generated by a venturi mechanism located in a spout assembly 17. Accordingly, fluid communications between the vacuum chamber 128 and a spout assembly 17 is provided by a vacuum conduit 132.

The spout assembly 17 includes a liquid tube 134 for being placed in fluid communication with the first outlet 20 of the body 12 so as to communicate liquid from the liquid passageway 14 to the tank or other container being filled. A spout tube 136 is also provided for being placed in fluid communication with the second inlet 22 of the body 12 so as to communicate vapor from the tank or other container being filed to the second inlet 22. In this regard, the liquid tube 134 is disposed within the spout tube 136 such that a further vapor passageway 16 is defined between the liquid tube 134 and the interior walls of the spout tube 136. In order to releasably secure the spout tube 136 to the body 12, an support ring 138 and a spout nut 140 are provided. The support ring 138 includes a proximal end portion 142 which is received in the second inlet 22 and a distal end portion defining a receptor 144 for releasably receiving a proximal end portion 146 of the spout tube 136. A circumscribing flange 147 is provide around the support ring 138 for engaging the body 12, with the flange 147 being releasably secured against the body 12 with the spout nut 140 which is threadably received on the body 12. In order to prohibit rotation of the spout tube 136 relative to the body 12, a set screw 148 is threadably mounted in the spout nut 140 such that it releasably engages the support ring 138.

The liquid tube 134 is held in position within the spout tube 136 with a first tube support member 150 and a further tube support member 152 (see FIG. 1). The first tube support member 150 defines a passageway 154 therethrough and a first end portion 156 which is received in the proximal end portion 142 of the support ring 138. The first end portion 156 of the first tube support member 150 is provided with a receptor 158 which slidably receives a proximal end portion 160 of the liquid tube 134, thereby establishing fluid communication between the liquid tube 134 and the passageway 154 of the first tube support member 150. The further tube support member 152 is mounted in the distal end of the spout tube 136 and defines an opening 162 therethrough into which the distal end portion 164 of the liquid tube 134 is received. It will also be noted that openings 166 are provided in the spout tube 136 proximate the distal end of the spout tube 136, just upstream from the further tube support member 152, for communicating vapor from the tank or container being filled into the further vapor passageway $16^1$.

Figure 4:
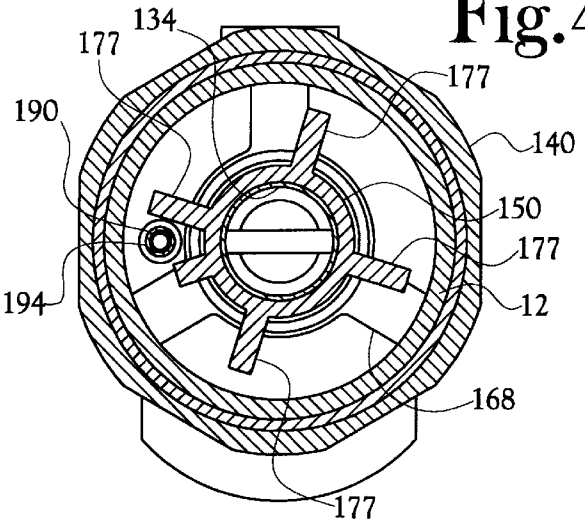
FIG. 4 illustrates an end view, in section taken at 4—4 in FIG. 3, of a liquid dispensing nozzle of the present invention.
Figure 6:
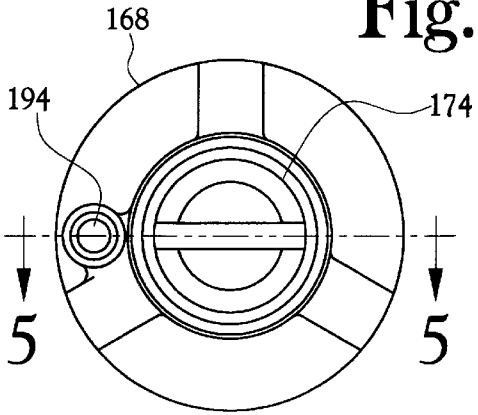
FIG. 6 illustrates an end view of a check valve housing of the liquid dispensing nozzle of the present invention.

In order to establish fluid communication between the first outlet 20 of the body 12 and the first tube support member 150, and in order to support the venturi mechanism, a check valve housing 168 is provided. As best illustrated in FIG. 3, the check valve housing 168 defines a first end portion 170 which is releasably received in the first outlet 20, and defines a liquid passageway 172 therethrough for communicating with the liquid passageway 14. A second end portion of the check valve housing 168 defines a receptor 174 which releasably receives a second end portion 176 of the first tube support member 150, thereby establishing fluid communication between the passageway 154 and the passageway 172. It will be noted that the check valve housing 168 maintains the first tube support member 150 in a coaxial position relative to the support ring 138. Further, the first end portion 156 of the first tube support member 150 defines a diameter which is smaller than the interior walls of the support ring 138. As a result, a circumferential space 184 is defined between the first tube support member 150 and the support ring 138 such that vapor can be communicated from the vapor passageway 16, to the passageway 16 of the body 12. Also, the first tube support member 150 is provided with a plurality of stop members 177 such that the relative positioning of the first tube support member 150 and the support ring 138 along their common axis is maintained. (See FIGS. 3 and 4).

In the preferred illustrated embodiment, the check valve housing 168 is held in position in the first outlet 20 with a set screw 151. The set screw 151 is received through an opening 153 in the body 12 and threadably received in a recess 155 provided in the check valve housing 168. It will be recognized that the set screw 151 not only secures the axial position of the check valve housing 168, but prohibits the check valve housing 168 from rotating relative to the body 12.

The venturi mechanism includes a check valve 178 mounted within the check valve housing 168 so as to be coaxially reciprocatable within the passageway 172, and further includes a valve seat member 180 which is releasably received in the passageway 172 to provide a valve seat for the check valve 178, and a valve spring 182 is provided for biasing the check valve 178 into contact with the valve seat member 180. The valve spring 182 has a preselected actuating force which allows the valve 178 to move out of engagement with the valve seat member 180 in response to normal dispensing pressure so as to allow liquid to flow through the check valve housing 168. However, when the main valve 26 is closed, and pressure down stream from the main valve 26 falls below a selected value, the valve spring 182 biases the check valve 178 into engagement with the valve seat member 180. Accordingly, the check valve 26 allows any excess fluid pressure down stream from the main valve 26 to be relieved, but thereafter closes to retain any residual liquid within the liquid passageway 14.

In order to selectively generate the vacuum necessary to actuate the further automatic shut off mechanism 106, the valve seat member 180 is provided with at least one, and preferably a plurality of conduits 186 which establish fluid communications between the inner face of the valve seat member 180 and a space 188 defined between the exterior surface of the valve seat member 180 and the walls of the passageway 14. In this regard, it will be noted that the vacuum conduit 132 communicates with the space 188 such that the fluid communication is established between the conduits 186 and the vacuum chamber 128. Further, a venting tube 190 (see FIGS. 1 and 4) extends between an opening 192 in the spout tube 136 proximate the distal end of the tube 136 and the check valve housing 168. As illustrated in FIGS. 4–7, the check valve housing 168 is provided with a venting conduit 194 which establishes fluid communication between the venting tube 190 and a space 196 (see FIG. 3) defined between the exterior of the check valve housing 168 and the interior walls of the passageway 14. The space 196 communicates with the space 188 defined between the exterior walls of the valve seat member 180 and the interior walls of the passageway 14. In the preferred illustrated embodiment, such fluid communication is established by providing channels 198 in the exterior surface of the check valve housing 168 extending between the space 188 and the space 196. (See FIG. 7). Accordingly, fluid communication is established between the opening 192 and the space 188, and, as noted above, the space 188 is placed in fluid communication with the vacuum chamber 128 by the vacuum conduit 132.

With respect operation of the venturi mechanism and the further automatic shut-off mechanism 106, it will be recognized that as liquid is being dispensed through the nozzle 10 the flow of liquid between the check valve 178 and the valve seat member 180 generates a vacuum in the conduits 186. When fluid communication between the opening 192 and the space 188 is unobstructed, the space 188 and the vacuum chamber 128 are vented to the ambient atmosphere, and no vacuum is communicated to the vacuum chamber 128. However, when the opening 192 is obstructed, as when the level of liquid in the tank or container into which liquid is being dispensed reaches the distal end of the spout tube 136 and covers the opening 192, the space 188 and the vacuum chamber 128 are no longer vented to the ambient atmosphere and the vacuum generated in the conduits 186 is communicated to the vacuum chamber 128. As a result of the vacuum applied to the vacuum chamber 128, the vacuum diaphragm 126 is moved upward lifting the latch pin 96, and disabling the operating lever 60 such that the main valve 26 and the vapor valve 70 move to closed positions. Thus, when the level of liquid in the tank or container being filled reaches the discharge end of the spout tube 136, both the flow of liquid through the nozzle 10 and the flow of vapor through the nozzle 10 are automatically terminated.

In light of the above it will be recognized that the present invention provides a liquid dispensing nozzle having great advantages over the prior art. In this regard, the vapor passageway 16 has been incorporated into the nozzle 10 such that unnecessary complexity is avoided. It will also be noted that the spout assembly 17 can be quickly and easily removed from the body 12 to gain access to the first tube support member 150, the check valve housing 168, the valve seat member 180, and/or check valve 178. Accordingly, the nozzle 10 is easy and inexpensive to repair and maintain. Moreover, the design of the vapor recovery system of the nozzle 10 accommodates both an automatic shut-off mechanism which terminates dispensing when the receptacle being filled is full, and an automatic shut-off mechanism which terminates or prohibits dispensing in absence of dispensing pressure from the dispensing pump of a preselected value. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A liquid dispensing nozzle for dispensing a liquid into a liquid receptacle and for recovering vapor from the liquid receptacle during dispensing, said liquid dispensing nozzle comprising:

a body defining a liquid passageway therethrough, said liquid passageway being provided with a first inlet for being placed in fluid communication with a liquid dispensing device and a first outlet, said body further defining a vapor passageway therethrough, said vapor passageway defining a second inlet through which vapor is received from the liquid receptacle during dispensing and defining a second outlet through which vapor exits said body;

a spout assembly including a liquid tube for being placed in fluid communication with said first outlet of said body so as to facilitate the communication of liquid from said liquid passageway of said body to the receptacle, said liquid tube having proximal and distal end portions, said spout assembly also including a spout tube for being placed in fluid communication with said second inlet of said body and for facilitating the communication of vapor from the liquid receptacle to said second inlet of said body, said spout tube having proximal and distal end portions, said liquid tube being disposed within said spout tube such that a further vapor passageway is defined within said spout tube between said liquid tube and said spout tube, said spout assembly also including a support ring for releasably securing said spout tube to said body, said support ring defining proximal and distal end portions and a passageway therethrough, said distal end portion of said support ring defining a receptor for releasably receiving said proximal end portion of said spout tube, said support ring further including a means for releasably securing said support ring to said body whereby said passageway of said support ring is in fluid communication with said vapor passageway of said body, said means for releasably securing said support ring to said body including a spout nut for engaging said support ring and for being threadably received by said body so as to releasably secure said support ring against said body, said spout assembly further including a first tube support member for holding said liquid tube in position within said spout tube, said first tube support member defining a liquid passageway therethrough and defining a first end portion which is received in said proximal end portion of said support ring, said first end portion of said first tube support member being provided with a receptor for receiving said proximal end portion of said liquid tube, thereby establishing fluid communication between said liquid tube and said liquid passageway of said first tube support member, said first tube support member defining a second end portion; and a check valve housing for facilitating the communication of liquid from said first outlet of said body and to said liquid tube of said spout assembly, said check valve housing defining a liquid passageway therethrough for communicating with the liquid passageway of said body and defining a first end portion for engaging said body proximate said first outlet so as to place said liquid passageway of said body in fluid communication with said liquid passageway of said check valve housing, said check valve housing having a second end portion for engaging said spout assembly so as to establish fluid communication between said liquid tube and said liquid passageway of said check valve housing.

2. The liquid dispensing nozzle of claim 1 wherein said first end portion of said first tube support member defines an exterior surface spaced from an adjacent interior surface of said support ring such that a space is defined between said first end portion of said first tube support member and said support ring whereby fluid communication is established between said further vapor passageway of said spout assembly and said vapor passageway of said body.

3. The liquid dispensing nozzle of claim 2 wherein said space defined between said first end portion of said first tube support member and said support ring extends around the circumference of said first portion of said first tube support member.

4. The liquid dispensing nozzle of claim 2 wherein said second end portion of said check valve housing defines a receptor for releasably receiving said second end portion of said first tube support member.

5. The liquid dispensing nozzle of claim 1 wherein said body is provided with a cap member releasably mounted on said body whereby said cap member and said body define an automatic shut-off chamber and said check valve housing is provided with a venting conduit, and wherein said liquid dispensing nozzle further comprises:

a main valve mounted within said body between said first inlet and said first outlet of said liquid passageway for selectively opening and closing said liquid passageway to the flow of liquid, said main valve being normally biased to a closed position, said main valve being provided with an operating lever for selectively opening said main valve to the flow of liquid;

latch means for selectively closing and prohibiting the opening of said main valve; and automatic shut-off means for terminating the flow of liquid through said liquid passageway of said body when the level of liquid within the receptacle reaches said distal end portion of said spout tube, said automatic shut-off means including a vacuum diaphragm mounted between said cap member and said body transversely dividing said automatic shut-off chamber so as to define a vacuum chamber, said vacuum diaphragm being secured to said latch means such that preselected movement of said diaphragm releases said latch means so as to close and prohibit the opening of said main valve, said automatic shut-off means including a check valve mounted in said check valve housing and a valve seat member secured to said check valve housing for generating a venturi effect, and including a vacuum conduit for connecting in fluid communication said vacuum chamber with said valve seat member and with said venting conduit of said check valve housing, said automatic shut-off means also including a venting tube for connecting in fluid communication said venting conduit of said check valve housing with the distal end of said spout tube.

6. The liquid dispensing nozzle of claim 5 wherein said nozzle further comprises a vapor valve mounted within said body between said second inlet and said second outlet of said vapor passageway of said body for selectively opening and closing said vapor passageway to the flow of vapor, said vapor valve being normally biased to a closed position, said vapor valve being selectively opened by said operating lever. for releasably receiving said second end portion of said first tube support member so as to establish fluid communication between said liquid passageway of said first tube support member and said liquid passageway of said check valve housing.

7. A liquid dispensing nozzle for dispensing a liquid into a liquid receptacle and for recovering vapor from the liquid receptacle during dispensing, said liquid dispensing nozzle comprising:

a body defining a liquid passageway therethrough, said liquid passageway being provided with a first inlet for being placed in fluid communication with a liquid dispensing device and a first outlet, said body further defining a vapor passageway therethrough, said vapor passageway defining a second inlet through which vapor is received from the liquid receptacle during dispensing and defining a second outlet through which vapor exits said body;

a spout assembly including a liquid tube for being placed in fluid communication with said first outlet of said body so as to facilitate the communication of liquid from said liquid passageway of said body to the receptacle, said liquid tube having proximal and distal end portions, said spout assembly also including a spout tube for being placed in fluid communication with said second inlet of said body and for facilitating the communication of vapor from the liquid receptacle to said second inlet of said body, said spout tube having proximal and distal end portions, said liquid tube being disposed within said spout tube such that a further vapor passageway is defined within said spout tube between said liquid tube and said spout tube, said spout assembly also including a support ring for releasably securing said spout tube to said body, said support ring defining proximal and distal end portions and a passageway therethrough, said distal end portion of said support ring defining a receptor for releasably receiving said proximal end portion of said spout tube, said support ring further including a means for releasably securing said support ring to said body whereby said passageway of said support ring is in fluid communication with said vapor passageway of said body, said means for releasably securing said support ring to said body including a spout nut for engaging said support ring and for being threadably received by said body so as to releasably secure said support ring against said body, said spout assembly further including a first tube support member for holding said liquid tube in position within said spout tube, said first tube support member defining a liquid passageway therethrough and defining a first end portion which is received in said proximal end portion of said support ring, said first end portion of said first tube support member being provided with a receptor for receiving said proximal end portion of said liquid tube, thereby establishing fluid communication between said liquid tube and said liquid passageway of said first tube support member, said first tube support member defining a second end portion; and a check valve housing defining a liquid passageway therethrough for establishing fluid communication between said liquid passageway of said body and said liquid passageway of said first tube support member, said check valve housing having a first end portion for being received in said first outlet so as to place said liquid passageway of said body in fluid communication with said liquid passageway of said check valve housing, said check valve housing having a second end portion defining a receptor for releasably receiving said second end portion of said first tube support member so as to establish fluid communication between said liquid passageway of said first tube support member and said liquid passageway of said check valve housing.

8. The liquid dispensing nozzle of claim 7 wherein said spout nut is provided with a set screw for threadably engaging said support ring whereby said support ring is prohibited from rotating relative to said body.

9. The liquid dispensing nozzle of claim 7 wherein said support ring is provided with an outwardly disposed circumferential flange for locking said support ring against said body.

10. The liquid dispensing nozzle of claim 7 wherein said first end portion of said first tube support member defines an exterior surface spaced from an adjacent interior surface of said support ring such that a space is defined between said first end portion of said first tube support member and said support ring whereby fluid communication is established between said further vapor passageway of said spout assembly and said vapor passageway of said body.

11. The liquid dispensing nozzle of claim 10 wherein said space defined between said first end portion of said first tube support member and said support ring extends around the circumference of said first portion of said first tube support member.

12. The liquid dispensing nozzle of claim 7 wherein said check valve housing is provided with a threaded receptor and said body is provided with a set screw for being releasably received in said threaded receptor of said check valve housing, whereby said check valve housing is releasably maintained in a fixed position relative to said body.

13. The liquid dispensing nozzle of claim 7 wherein said body is provided with a cap member releasably mounted on said body whereby said cap member and said body define an automatic shut-off chamber and said check valve housing is provided with a venting conduit, and wherein said liquid dispensing nozzle further comprises:

a main valve mounted within said body between said first inlet and said first outlet of said liquid passageway of said body for selectively opening and closing said liquid passageway of said body to the flow of liquid, said main valve being normally biased to a closed position, said main valve being provided with an operating lever for selectively opening said main valve to the flow of liquid;

latch means for selectively closing and prohibiting the opening of said main valve; and automatic shut-off means for terminating the flow of liquid through said liquid passageway of said body when the level of liquid within the receptacle reaches said distal end portion of said spout tube, said automatic shut-off means including a vacuum diaphragm mounted between said cap member and said body transversely dividing said automatic shut-off chamber so as to define a vacuum chamber, said vacuum diaphragm being secured to said latch means such that preselected movement of said diaphragm releases said latch means so as to close and prohibit the opening of said main valve, said automatic shut-off means including a check valve mounted in said check valve housing and a valve seat member secured to said check valve housing for generating a venturi effect, and including a vacuum conduit for connecting in fluid communication said vacuum chamber with said valve seat member and with said venting conduit of said check valve housing, said automatic shut-off means also including a venting tube for connecting in fluid communication said venting conduit of said check valve housing with the distal end of said spout tube.

14. The liquid dispensing nozzle of claim 13 wherein said nozzle further comprises a vapor valve mounted within said body between said second inlet and said second outlet of said vapor passageway of said body for selectively opening and closing said vapor passageway to the flow of vapor, said vapor valve being normally biased to a closed position, said vapor valve being selectively opened by said operating lever.

* * * * *